United States Patent [19]

Lerude et al.

[11] Patent Number: 4,503,409

[45] Date of Patent: Mar. 5, 1985

[54] ELECTRO-MAGNETIC SWITCH DEVICE HAVING DIFFERENT OPEN OR CLOSED SWITCH CONFIGURATIONS

[75] Inventors: Gerard Lerude, Antibes; Claude Jullien, Thenezay, both of France

[73] Assignee: La Telemecanique Electrique, France

[21] Appl. No.: 454,311

[22] Filed: Dec. 29, 1982

[30] Foreign Application Priority Data

Dec. 30, 1981 [FR] France ..... 81 24490

[51] Int. Cl.[3] ..... H01H 67/02

[52] U.S. Cl. ..... 335/132; 335/198; 200/280

[58] Field of Search ..... 335/132, 133, 192, 198, 335/131; 200/261, 280

[56] References Cited

U.S. PATENT DOCUMENTS 3,202,785 8/1965 Jelley ..... 335/132
3,873,952 3/1975 Kondo et al. ..... 335/132

FOREIGN PATENT DOCUMENTS 1062665 3/1967 United Kingdom ..... 335/132

*Primary Examiner*—E. A. Goldberg
*Assistant Examiner*—George Andrews
*Attorney, Agent, or Firm*—William A. Drucker

[57] ABSTRACT

An electro-magnetically controlled apparatus is provided having in a box an electro-magnet adapted to move an armature subjected to the force of a return spring developing an initial force, a contact holder associated with the armature and presenting side by side a plurality of pairs of housings each comprising a lower housing close to the armature, and an upper housing placed above, a plurality of mobile reversible bridge contacts, respectively placed in the respective housings and each receiving the action of a pressure spring which urges them against a cross piece separating two housings of a pair, these bridge contacts being adapted to cooperate each one with a pair of fixed reversible contacts disposed in the case so as to form one of the possible configurations of opening or closing switches placed in power or signalling circuits. The contact holder (9) comprises four pairs or superimposed housings ($10_U$—$11_U$, $10_V$—$11_V$, $10_W$—$11_W$, $10_X$—$11_X$).

5 Claims, 11 Drawing Figures

FIG.4
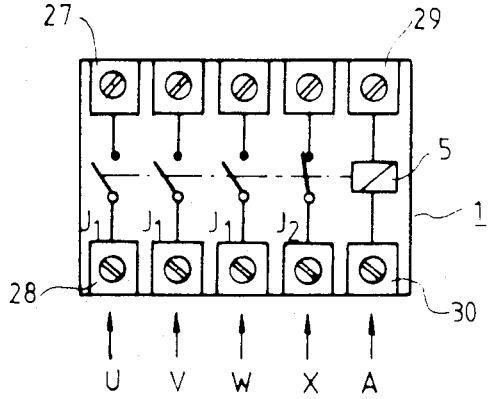
FIG.5
| CONFIGURATIONS | TERMINALS | | | | | RETURN SPRING |
|---|---|---|---|---|---|---|
| | SWITCHES | | | | COIL | |
| | U | V | W | X | A | |
| 2T + 2R | T | R | R | T | A | $7_I$ |
| 2F + 2O | F | O | O | F | A | |
| 4T | T | T | T | T | A | $7_{II}$ |
| 4F | F | F | F | F | A | |
| 3T + F | T | T | T | F | A | |
| 3T + O | T | T | T | O | A | |
| 3F + O | F | O | F | F | A | |
FIG.8
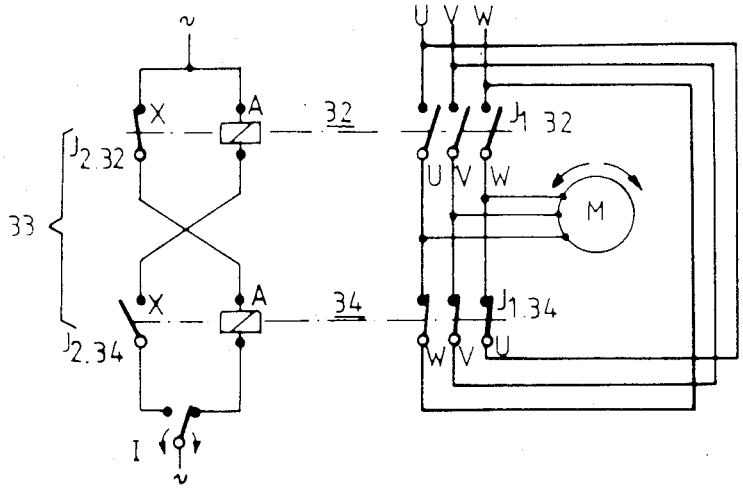

ELECTRO-MAGNETIC SWITCH DEVICE HAVING DIFFERENT OPEN OR CLOSED SWITCH CONFIGURATIONS

BACKGROUND OF THE INVENTION

The invention relates to an electro-magnetically controlled switch apparatus having in a case an electro-magnet adapted to move an armature subjected to the force of a return spring developing an initial force, a contact holder associated with the armature and presenting side-by-side a plurality of pairs of housings each comprising a lower housing close to the armature and an upper housing placed above, a plurality of reversible mobile bridge contacts respectively placed in the respective housings and each receiving the action of a pressure spring which applies them with an initial force against a cross piece separating two housings of a pair, these bridge contacts being adapted to cooperate each one with a pair of fixed reversible contacts disposed in the case, so as to form one or several possible configurations of opening or closing switches placed in signalling or power circuits.

THE PRIOR ART

Such apparatus are widely used in industrial installations where it is required of the same type of apparatus, that is to say the apparatus always having the same external dimensions, the same connecting terminal arrangements and the same electro-magnets, for supplying solely power circuits, or for supplying power circuits and controlling, signalling, relay or processing circuits, or else solely for supplying signalling, relay or processing circuits.

The problem which arises in this case results from the difficulty which the same electro-magnet meets in attracting an armature and closing a contact holder which presents a very varying resistant force depending on the contact combination with which it is equipped. In effect, the contact pressures which are required for closing the power circuits must be high whereas the contact pressures required for establishing signalling or relay circuits may be smaller; moreover, opening switches, whether they are power or relay switches exert forces which facilitate attraction of the armature, and which depend then on the number of these switches.

These problems become more acute when it is desired to use only one and the same electro-magnet having reduced dimensions, for in this case the power of this electro-magnet is calculated to just what is necessary and the distance which separates the armature at rest from the yoke may be relatively more considerably affected by manufacturing tolerances to which are added the tolerances of the supply voltage for the coil of the electro-magnet, as well as variations in resistance which this latter may present when warm.

The solution to these problems becomes even more delicate when, in the same model of apparatus, the European standards must be complied with for disposing the terminals of the opening switches either between the terminals of the closing switches if these opening switches are two in number and concern apparatus intended for relaying, or for disposing these opening or closing relay switch terminals at the side of the closing switch terminals when these latter concern a power apparatus, or for disposing these opening relay switch terminals between two closing relay switches and in a position which is not close to the position of the opening relay switch defined immediately above.

Finally, when two identical switch apparatus must or may be electrically associated so as to form a switch inverter system with electric locking (for example for a known motor direction reversal circuit where two apparatus are used each having three closing power switches and an opening relay switch), it is indispensable to take precautions so that no current flows in the circuit of the relay switch of the first apparatus before the relay switch of the other apparatus is closed.

This precaution, which means that the apparatus whose electro-magnet is not energized cannot close its power switches before the power switches of the other apparatus are open implies that the attraction time of the armature of one apparatus is not too short with respect to the return time of the armature of the other apparatus; it is then indispensable that the net balance of the drive and resisting force which is communicated to the mobile assembly of the apparatus is just enough for the progressive attraction of the assembly.

In known apparatus, whose general construction complies with the one mentioned above, the solutions chosen are based on the use of a relatively powerful electro-magnet or on a particular form, number or arrangement of the fixed and/or mobile contacts, or else on a modification of the forces of the contact pressure springs.

These solutions are technically expensive, since they lead either to an increase in consumption and copper, or to the need to provide a very great variety of fixed contacts, mobile contacts and even in some cases contact pressure springs, which, during fitting, presents dangerous risks of confusion.

All these measures are difficult to put into practice when the arrangement of the terminals must, in addition, follow the corresponding standards.

OBJECT OF THE INVENTION

It is an object of the invention to provide an apparatus whose general construction corresponds to that of the prior art, but in which precautions will be taken on the one hand so that the dimensions of the electro-magnet are as small as possible and, on the other hand, so that the number of separate parts required for the construction of apparatus having very different contact combinations is reduced to the strict minimum, this apparatus having both an arrangement of the connection terminals which corresponds to the requirements of European standards and an inversion time which is compatible with use as switch/invertor.

SUMMARY OF THE INVENTION

According to the invention the desired result is attained because the contact holder comprises four pairs of superimposed housings:

the upper housings having surfaces of application for a flat closing switch contact bridge, which are placed in a first plane perpendicular to the axis of movement of the contact holder and bearing surfaces for a pressure spring which are placed in a second plane parallel to the first plane, the lower housings having bearing surfaces for a flat opening switch contact bridge which are placed in a third plane parallel to the second plane, and three neighboring lower housings having application surfaces placed in a fourth plane parallel to the third plane, whereas a fourth lower plane has a plane of application placed in a fifth plane which is parallel to the third plane and is closer to this latter than the fourth plane, all the flat switch contact bridges being identical and cooperating by means of identical pressure springs with identical flat fixed contacts and placed in a sixth plane parallel to the other planes, one of two special return springs the first of which develops an initial return force greater than the one developed by the second spring being associated with the armature depending upon whether the configuration of the apparatus comprises either two closing switches and two opening switches, or one or no opening switch and three or four closing switches.

BRIEF DESCRIPTION OF THE DRAWINGS

The invention will be better understood from the following description. In the appended drawing:

FIG. 4 illustrates a top view of the case of a three-pole apparatus, showing the layout of the terminals belonging to the switches and to the coil of the electro-magnet;

FIG. 5 shows a table in which are mentioned the different configurations and arrangements of power and/or relay switches which may be met with in a standardized four-pole apparatus in Europe;

FIG. 8 illustrates an interconnection diagram for two apparatus having a configuration appropriate to reversal of the direction of rotation of a three-phase motor.

DESCRIPTION OF THE PREFERRED EMBODIMENT

Figure 1:
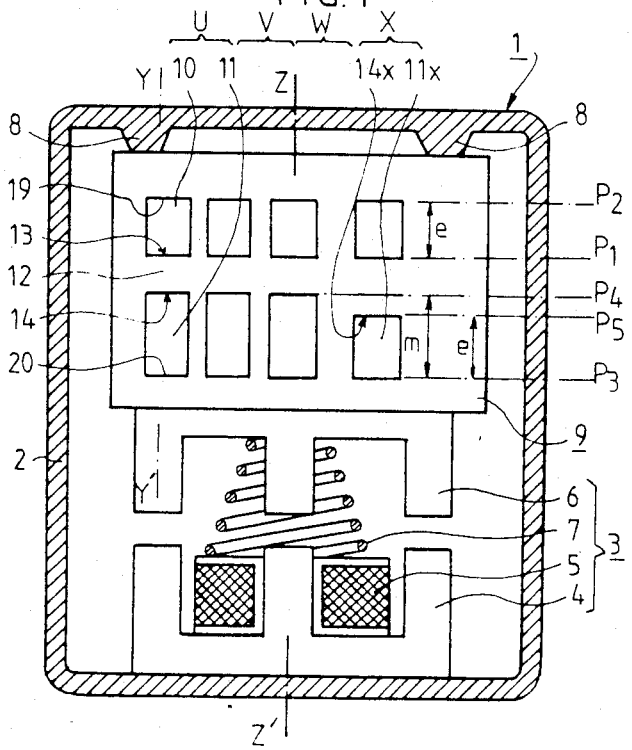
FIG. 1 shows a schematic sectional view of a switch apparatus according to the invention.

An electro-magnetically actuated switch apparatus such as shown at 1 in FIGS. 1 and 2, comprises a case 2 in which is located an electro-magnet 3, comprising a fixed yoke 4, a coil 5, a mobile armature 6 and a return spring 7; this spring exerts an initial return force F which maintains the contact holder against a stop 8 of the case when no current flows in the coil.

A contact holder 9 is associated with the armature, and consequently follows the movements thereof.

This contact holder 9 has a plurality of pairs of housings placed in columns U, V, W, X. Each pair comprises an upper housing such as $\mathbf{10}_U$, $\mathbf{10}_V$, . . . and a lower housing $\mathbf{11}_U$, $\mathbf{11}_V$, . . . which is separated therefrom by a cross piece $\mathbf{12}_U$, $\mathbf{12}_V$, $\mathbf{12}_W$, $\mathbf{12}_X$. Each cross piece comprises an upper application surface $\mathbf{13}_U$, . . . $\mathbf{13}_X$ and a lower application surface $\mathbf{14}_U$, . . . $\mathbf{14}_X$.

A single housing, upper or lower, of the same pair is occupied, depending on one of two possible orientations a or b, by a flat reversible mobile contact bridge 15 or 17. A spring 16 or 18 tends to urge the bridge towards an application surface placed opposite thereto while bearing on an upper 19 or respectively lower 20 bearing surface (see FIGS. 2*a* and 2*b*).

Figure 2A:
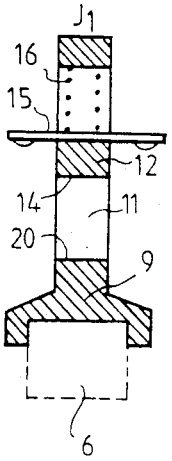
FIGS. 2*a* and 2*b* show a side view of the contact holder of FIG. 1, in section through a plane YY' and equipped either with a closing switch FIG. 2*a*, or with an opening switch (FIG. 2*b*)
Figure 2B:
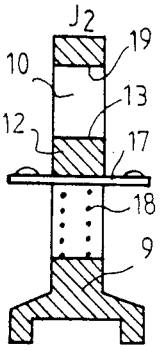

Two reversible flat fixed contacts, such as 21 and 22 or 23 and 24 are disposed in compartments 25 respectively 26 of case 2 (see FIGS. 3*a* and 3*b*), and may assume one of two possible orientations a or b so that their contact insets are directed towards the insets of the contact bridge which is associated therewith and are situated substantially in the same plane P6. The orientation of the contacts in FIGS. 2*a* and 3*a* give closing switches of type $J_1$ whereas the orientation of the contacts in FIGS. 2*b* and 3*b* gives opening switches of type $J_2$.

Figure 3A:
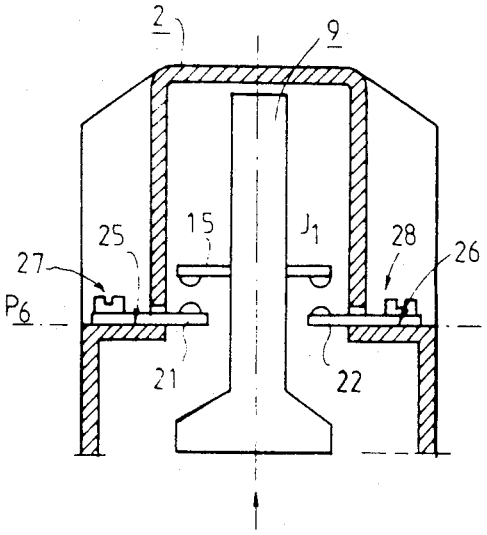
FIGS. 3*a* and 3*b* illustrate a partial upper side view of the apparatus of FIG. 1, in a section partially through plane YY' where are to be found respectively the fixed contacts of closing and opening switches.
Figure 3B:
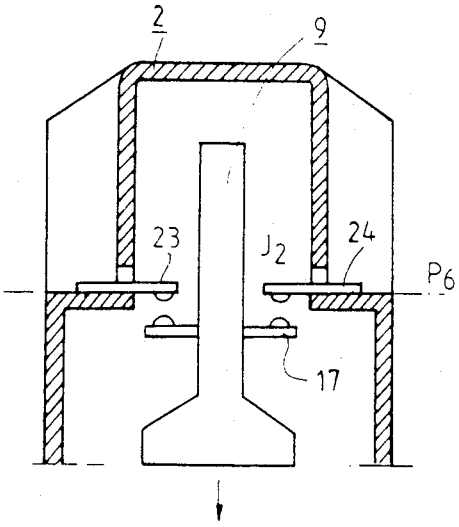

Each switch $J_1$ or $J_2$ is shown in FIGS. 3*a* respectively 3*b* in the open position, which occurs when armature 6 is not attracted or respectively, on the contrary when the armature is attracted. A switch such as $J_1$ will be called a work switch T if it closes a power circuit and a closing switch F if it establishes an auxiliary circuit for example a signalling or relay circuit.

A switch such as $J_2$ will be called a rest switch R, or opening switch O, according as to whether it interrupts a power circuit or an auxiliary circuit.

In all the possible cases of mounting, the pressure springs 16 or 18 used are identical and are initially under compression between a contact bridge and a bearing surface; the fixed contacts 21, 22 and 23, 24 on the one hand, and mobile contacts 15, 17 on the other, are also identical.

All the upper housings 10 have application surfaces 13 in the same plane $P_1$ defined with respect to the contact holder 9 and bearing surfaces 19 in the same plane $P_2$. All the lower housings 11 have bearing surfaces 20 placed in the same plane $P_3$, and three neighboring housings $\mathbf{11}_U$, $\mathbf{11}_V$, $\mathbf{11}_W$ have their application surfaces 14 in the same plane $P_4$, whereas the fourth lower housing $\mathbf{11}_X$ has an application surface $\mathbf{14}_X$ in a plane $P_5$ which is closer to $P_3$ than is plane $P_4$.

In a preferred embodiment, the upper housings and the lower housing $\mathbf{11}_X$ have the same hight e and the three lower housings $\mathbf{11}_U$, $\mathbf{11}_V$, $\mathbf{11}_W$ have a height m greater than e.

In a variation, the four upper housings may have the same height $e_1$ different from the height $e_2$ of the neighboring lower housing $\mathbf{11}_X$, this latter being despite everything less than height $m_1$ of the three lower housings $\mathbf{11}_U$, $\mathbf{11}_V$, $\mathbf{11}_W$.

It results from these two arrangements that the contact bridge 17 of switch $J_2$ placed in column X, receives an initial contact pressure which is greater than that which is received by another contact bridge of switch $J_2$ placed in another column U, V or W when the same pressure spring 17 is used in both cases. On the other hand, when all the switches $J_2$ are closed, the contact pressures effectively applied to the bridges will be equal.

Each switch $J_1$ or $J_2$ of each column U, V, W, X has two connecting terminals such as 27 and 28 (see FIG. 3*a*), and it can be seen in FIG. 4 that the switch terminals are arranged side by side, two special terminals 29, 30 supplying the coil of the electro-magnet.

The switch configurations and the corresponding terminal arrangements, recommended by the European standards, appear in the table of FIG. 5, where the letter A represents the terminals of the coil. It can be seen from this table that when a single opening switch $J_2$ (type R or O) is used, it is either associated with column V or with column X, and that when two opening switches $J_2$ (of type R or O) are used, they are associated with columns V and W. This special arrangement has been taken into account in the invention by giving to the opening switches $J_2$, which are in columns U, V, W, an initial contact pressure less than that of switch $J_2$ placed in column X and by associating in accordance with the configurations shown in this table two kinds of return springs of which one of category I has an initial return force $F_1$ greater than that $F_2$ of the other return spring of category II, the return spring I only being used for configurations 2T+2R or 2F+2O.

Figure 6:
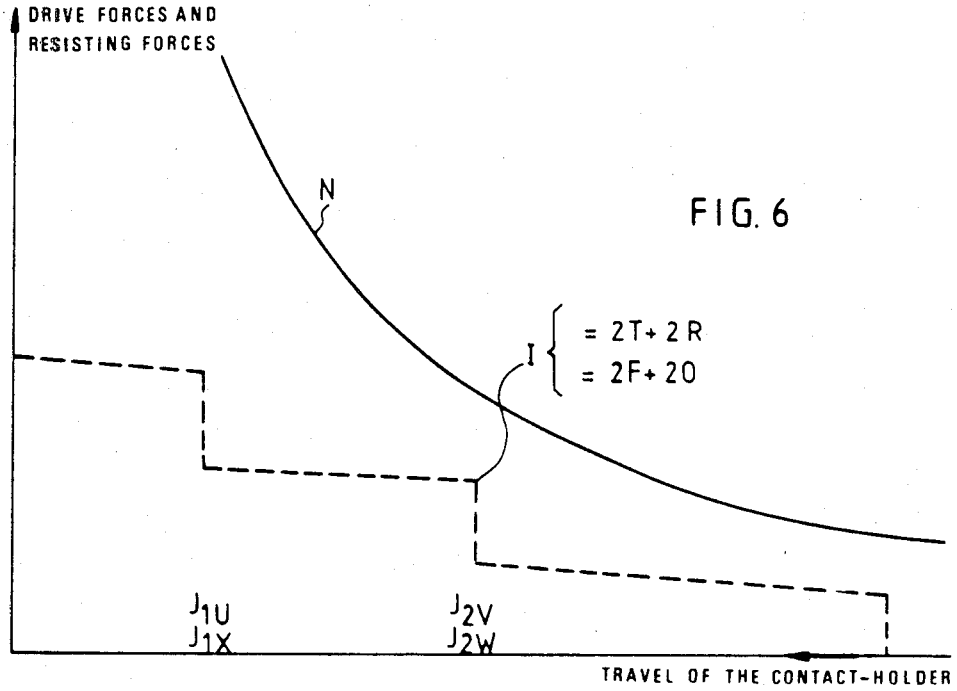
FIGS. 6 and 7 show the trend of the drive forces and of the resisting forces which may be observed in different apparatus configurations.
Figure 7:
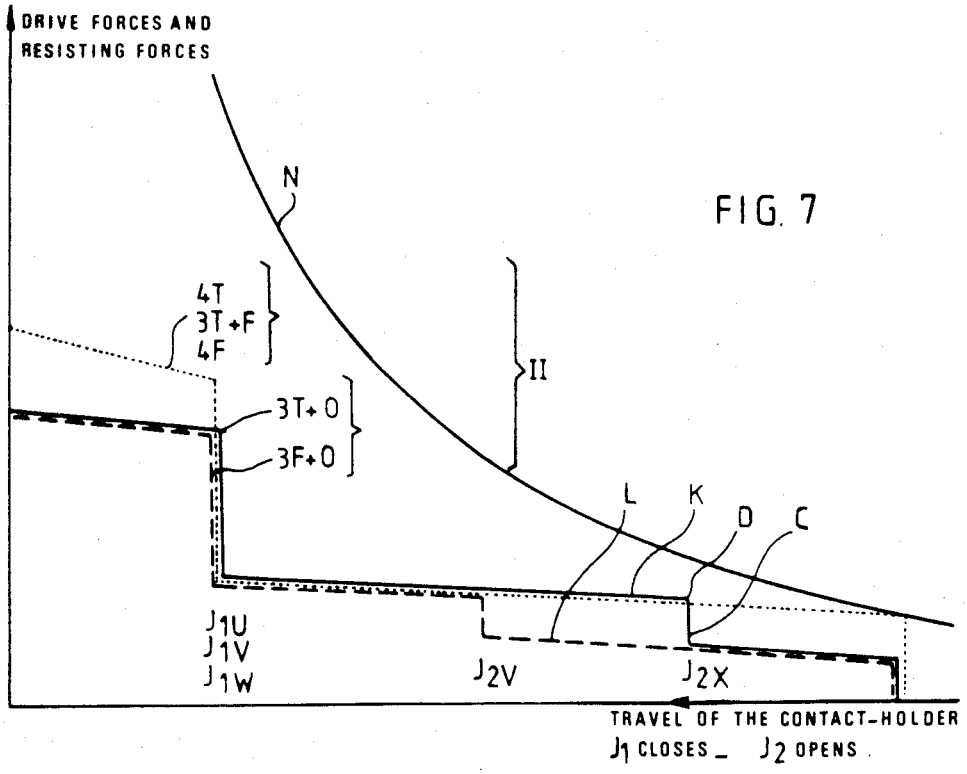

The diagrams of resisting forces and drive forces (these latter being always delivered by the same small electro-magnet), are illustrated in FIGS. 6 and 7.

It can be seen in the diagram of FIG. 7 that the evolution of the resisting forces K of configuration 3T+O (which is that of a small three-polar power contactor having an opening relay contact), takes place with a growth step C which is placed at about the first quarter of the travel and whose edge D is close to the attraction curve G of the electro-magnet.

The energy communicated to the mobile assembly, which comprises the armature, the contact holder and the mobile contacts is then more reduced than that which would have been communicated thereto if the height of housing $\mathbf{11}_X$ had been identical to that of the other housings. The result is that, for this configuration, the starting speed of this mobile assembly does not exceed a value which would be too high in the case of application to an inverting circuit, see FIG. 8.

An evolution of the resisting forces which would have been bad for a switch apparatus intended for switch/invertor functions is shown by curve L which relates to an apparatus having a configuration 3F+O. The functions of this latter, which are essentially orientated to relaying, are not however disturbed here by a very rapid movement of the contact holder.

The same can be said for configurations 4F, 4T, 3T+F which also use a return spring of category II and where the moving speed has no special importance. For configurations 2T+2R and 2F+2O, a return spring of an initial higher force here insures compensation of the two initial contact pressures at switches $J_2$, which consumes then a considerable proportion of the energy of the electro-magnet.

There is shown as a reminder in FIG. 8 a circuit used for forming with two switch apparatus 32, 34, of configuration 3T+O also shown in FIG. 4, a switch/invertor 33 having electric interlocking and intended for changing the direction of rotation of the motor M.

Figure 9:
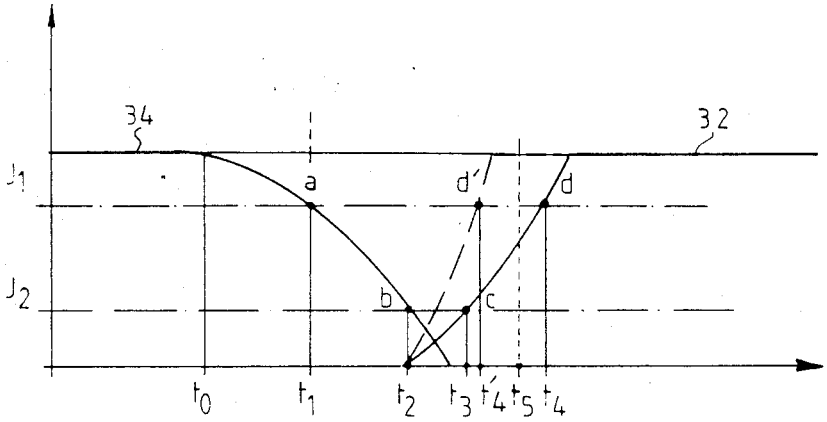
FIG. 9 shows an operating diagram of two contactors mounted as phase invertors according to FIG. 8.

The importance assumed by the rise time and fall time of two relays of contactors of the same type may be appreciated when they are mounted electrically as switch/invertor according to the circuit of FIG. 8, by referring to the operating diagrams shown in FIG. 9 where the time is plotted as abscissa and the movements or travels of the contact holder are plotted as ordinates.

With contactor 34 energized and contactor 32 deenergized an inversion order is given at time $t_0$ by the invertor I. At time $t_1$ and at point a in the downward travel of the corresponding contact holder shown on the lefthand descending curve, the power switches $J_{1.34}$ open, whereas the relay switch $J_{2.34}$ closes at point b and at time $t_2$. From this time $t_2$, the coil of relay 32 is energized and the contact holder of contact 32 effects a rising movement shown on the righthand rising curve. At point c and at time $t_3$ the relay switch $J_{2.32}$ opens, which prevents a further energization of contactor 34, whereas the power switches $J_{1.32}$ close at point d and at time $t_4$.

Since the case is presented during the opening of an inductive circuit, arcs appear between the contacts of the power switches as soon as $J_{1.34}$ opens and disappear at time $t_5$.

If $t_5$ is before $t_4$ as shown in this figure, the operation is correct for no current passes through contactor 34 when currents in opposite directions flow in 32. If, on the other hand, contactor 32 rises too quickly as shown on the broken line curve, it can be seen that the travel point d will take place at time $t'_4$ which is before time $t_5$; when this phenomenon occurs, lines U, V, W are short-circuited by the arcs which leads to the dangers and damage which are known.

In these diagrams, which have been simplified for the sake of clarity, account has not been taken of the demagnetization and magnetization times of the electro-magnets of the two contactors.

The contactor of the invention is able to comply simultaneously, on the one hand, with the requirements of the standards relative to the location of the switch terminals and, on the other hand, to the requirements of rational manufacture at reduced technical cost, and presents rise and fall time characteristics such that its association with an identical contactor in an invertor circuit may be effected with every safety.

We claim:

1. An electro-magnetically controlled switching assembly adaptable to form anyone of a plurality of combinations of four contact units, said combinations being of a first type comprising two normally open and two normally closed contact units, of a second type comprising one normally closed and three normally open contact units and of a third type comprising four normally open contact units, said assembly having in a case a single electro-magnet cooperating with a single movable armature; first and second return springs respectively developing first and second predetermined initial forces, the first initial force being substantially greater than the second initial force, said first and second return springs being adapted to be detachably secured between the movable armature and the electro-magnet; a single contact holder rigidly coupled to the armature and presenting side by side first, second, third and fourth pairs of housings, each pair comprising a lower housing close to the armature and an upper housing more remote from the armature than the first housing, four reversible movable contact bridges respectively lodged in the respective pairs of housings, said movable contact bridges respectively receiving the action of four respective pressure springs which urge them against four respective cross bars respectively separating the upper and lower housings of the respective pairs, four reversible pairs of stationary contacts mounted in the case for respectively cooperating with the four respective movable contact bridges, the four upper housings each having an upper application surface on an upper face of the respective cross member, which is adapted for receiving a movable contact bridge which will form, with a cooperating said pair of stationary contacts, a normally open contact unit and an opposite bearing surface which is adapted for receiving one said pressure spring and substantially parallel to said upper application surface;

the four lower housings each having, on a lower face of the respective cross member, a lower application surface which is adapted for receiving a movable contact bridge which will form, with a cooperating said pair of stationary contacts, a normally closed contact unit, and an opposite bearing surface which is adapted for receiving one said pressure spring and substantially parallel to said lower application surface;

the respective distances between the upper application surfaces and the opposite bearing surfaces of the respective upper housings of the first, second, third and fourth pairs having a first predetermined length, the distances between the lower application surfaces and the opposite bearing surfaces of the respective lower housings of the first, second and third pairs having a second predetermined length and the distance between the lower application surface and the opposite bearing surface of the lower housing of the fourth pair having a third predetermined length which is smaller than the second predetermined length; the said four movable contact bridges being substantially identical, the said four pairs of stationary contacts being substantially identical, the said four pressure springs being substantially identical and the first return spring being used in the combinations of the first type whereas the second return spring is used in the combinations of the second and third type.

2. A switch assembly as claimed in claim 1, wherein the said first and third predetermined lengths are identical.

3. A switch assembly as claimed in claim 2, wherein the first and second predetermined lengths are such that the movable contact bridge of a normally closed contact unit located in the fourth pair of housings will bear on the said lower application surface, when the said contact holder substantially has covered one quarter of its attraction travel.

4. A switch assembly as claimed in claim 3, wherein the movable contact bridge of a normally closed contact unit located in the second or third pairs of housings will bear on the said lower application surface when the said contact holder substantially has covered one half of its attraction travel.

5. A switch assembly as claimed in claim 4, wherein the movable contact bridge of a normally open contact unit will enter into engagement with the cooperating stationary contact pair when the said contact holder substantially has covered three-quarters of its attraction travel.

* * * * *